United States Patent [19]

Kosek et al.

[11] 4,026,107

[45] May 31, 1977

[54] ELECTROHYDRAULIC PRESS DRIVE SYSTEM

[75] Inventors: Andrzej Kosek; Adam Grudzewski, both of Krakow, Poland

[73] Assignee: Osrodek Badawczo-Rozwojowy Przemyslu Budowy Urzaszen Chemicznych "Cebea", Krakow, Poland

[22] Filed: Nov. 17, 1975

[21] Appl. No.: 633,021

[30] Foreign Application Priority Data

Nov. 23, 1974 Poland ..... 175892

[52] U.S. Cl. ..... 60/413; 60/414; 60/419

[51] Int. Cl.[2] ..... F15B 1/02

[58] Field of Search ..... 60/413, 414, 415, 419, 60/371, 404, 405, 384, 445, 479

[56] References Cited

UNITED STATES PATENTS

| | | | |
|---|---|---|---|
| 2,554,381 | 5/1951 | Patterson | 60/413 X |
| 2,576,359 | 11/1951 | Putnam | 60/414 |
| 2,827,763 | 3/1958 | Govan et al. | 60/414 |
| 2,984,985 | 5/1961 | MacMillin | 60/471 X |
| 3,779,017 | 12/1973 | Fujisawa et al. | 60/413 |
| 3,871,714 | 3/1975 | Behrend | 60/413 X |
| 3,874,173 | 4/1975 | Wilkins | 60/445 X |
| 3,903,696 | 9/1975 | Carman | 60/414 |

*Primary Examiner*—Edgar W. Geoghegan

[57] ABSTRACT

An electrohydraulic press drive system comprising a pressure transformer with variable ratio of displacement volume connected in series in a drive hydraulic circuit between a gas-hydraulic accumulator and a press cylinder. The pressure transformer consists of a hydraulic motor, which is connected mechanically with a hydraulic pump, the source of drive power of the pressure transformer being the gas-hydraulic accumulator.

1 Claim, 1 Drawing Figure

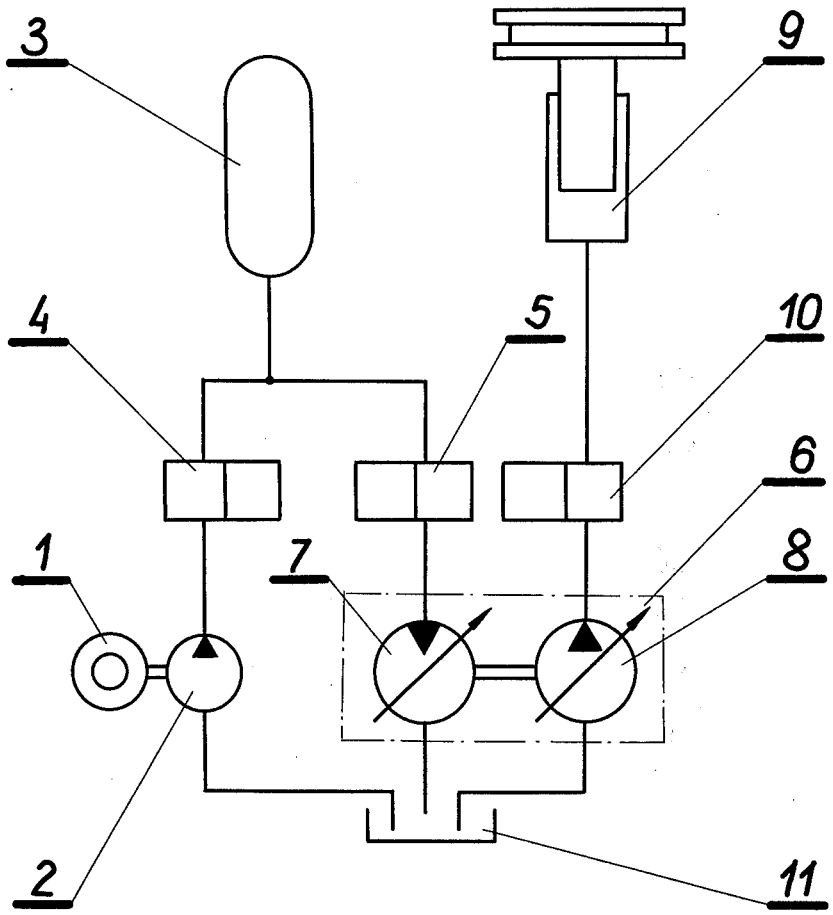
3
9
4
5
10
6
1
7
8
2
11

ELECTROHYDRAULIC PRESS DRIVE SYSTEM

The invention relates to an electrohydraulic system for driving presses, in particular fibreboard and chipboard presses and other presses with a similar power consumption cycle.

The hitherto known and applied two-stage pump system is provided with constant delivery pumps, driven by electric motors, whereby these pumps supply the pressure fluid directly to the press cylinders. Despite their unquestionable advantages consisting in that the drive system shows high energetic efficiency, there exist some drawbacks of the system due to the high installed power which equals the peak power absorbed by the press. The power is tapped from electric mains for a short time period, i.e. approx. one fifth of the pressing cycle, while during the remaining pressing cycle the motors are running idle with a very low power consumption factor.

Another pump system is known, which is provided with variable delivery pumps, which ensures high power efficiency at a simultaneous lowering of installed power, however, despite the fact that this power equals the medium and not the peak power of the period of supplying the energy to the press, in the final account this power is still high, because during four/fifths of the pressing cycle period the motors are running idle, thus impairing the power consumption factor of the whole factory. This accounts for the rise of the costs of electric power installation.

A still another known and used drive system called accumulator system consists of low and high-pressure pumps driven by electric motors, which pumps load the corresponding low and high-pressure accumulators. The pressure fluid from these accumulators is directed through hydraulic flow control apparatus to the press cylinders. The main drawback of this system is a very low energetic efficiency amounting to about 40 percent (with exclusion of the electromechanical system).

Such a low efficiency results from the fact that accumulators are loaded to a maximum pressure, and the pressure in the cylinders of the press rises gradually from zero. The difference of pressure in accumulator and pressure in the press cylinder, multiplied by the amount of flowing liquid provides the quantity of lost energy transformed into heat in the throttling apparatus. Besides, this system requires the application of hydraulic accumulators of high output volume.

The purpose of the invention is the removal of drawbacks of said systems by elaboration of a electrohydraulic system permitting obtaining high energetic efficiency at a least installed power, whereby the tapping of this power from the electric mains by means of this system shall be effected uniformly during the whole time of the press working cycle.

The electrohydraulic system being the subject of this invention is realized in such a manner that a pressure transformer with variable ratio of displacement volume consists of a hydraulic pump, the source of drive energy of the pressure transformer being the gas-hydraulic accumulator, said pressure transformer being switched in series in the hydraulic drive circuit between the gas-hydraulic accumulator and the cylinder of the hydraulic press.

The advantage of the electrohydraulic system according to the invention consists in full utilization of the energy accumulated in the gas-hydraulic accumulator, since there exists no necessity to use a throttle for the adaptation of the pressure supplied by the accumulator to the technological resistance of the cylinders of the hydraulic press, the result is that the energetic efficiency of the system is very high, i.e. the ratio of the energy used in the hydraulic press to the energy put in is practically one to one.

In the system according to the invention the task of the adjustment of the pressure being supplied to the pressure needed in the cylinders of the hydraulic press is fulfilled by a pressure transducer with variable ratio of swept volume.

A further advantage consists in the need for only a small amount of electric power at the input to the system, since the amount of energy stored in the gas-hydraulic accumulator approximately equals the power needed in performing the pressing work. Besides, the system according to invention distinguishes itself as compared with the hitherto used accumulator applied is considerably smaller.

The subject of the invention is shown in an example of a design in the diagrammatic drawing.

As shown in the drawing, the electrohydraulic system according to invention, consists of electric motor 1, which drives the pump 2 designed for loading the gas-hydraulic accumulator 3 through a set of valves 4. The gas-hydraulic accumulator 3 is connected through a set of valves 5 with the pressure transformer 6 which has a variable ratio of displacement volume, whereby the pressure transformer 6 consists of a hydraulic motor 7 connected mechanically with a hydraulic pump 8. Both the hydraulic motor 7 and the hydraulic pump 8 have a variable displacement volume, or either the pump only, or the motor only can have variable displacement. The pressure transformer includes also, not shown in the drawing, a controller, whose purpose is the setting up of a mutual ratio of displacement volumes of the hydraulic pump 8 and/or hydraulic motor 7, depending on the ratio of the pressure of the gas-hydraulic accumulator 3 to the pressures needed in the cylinders 9 of the hydraulic press. The hydraulic pump 8 is connected with cylinder 9 of the press by means of a set of valves 10. The hydraulic pump 2 and the hydraulic pump 8 tap the fluid from a tank 11 which also receives the fluid from the hydraulic motor 7.

The operation of the electrohydraulic system, according to the invention, is as follows: at the beginning of the pressing phase constituting a portion of the whole press working cycle — the ratio of displacement volumes of the hydraulic motor 7 is set up at the highest value, due to which the flow of the pressure fluid at a small rate and high pressure from the gas-hydraulic accumulator 3 through the set of valves 5 and the hydraulic motor 7 causes the flow of pressure fluid at high rate and small pressure from the hydraulic pump 8 through the set of valves 10 to the cylinder 9 of the hydraulic press. With the increase of the pressure in the cylinder 9 of the press, caused by the increase of the technological resistance, the controller (not shown) of the pressure transformer (6) causes a reduction of the ratio of the displacement volume of the hydraulic pump 8 to the displacement volume of the hydraulic motor 7, thus permitting the increase of the pressure of the working fluid delivered by the hydraulic pump 8, at a simultaneous decreasing of the flow rate.

The electrohydraulic system, according to the invention, is suited, in particular in hydraulic presses designed for pressing materials whose required pressure force increases with the increase of the pressing path and the energy consumption is effected in a much shorter time than the time of the whole press working cycle.

We claim:

1. Electrohydraulic press apparatus comprising a hydraulic output cylinder, a hydraulic pump coupled to said cylinder to pressurize the same, a source of hydraulic fluid coupled to said pump, said cylinder, pump and source of fluid forming a first hydraulic circuit, a motor-driven pump coupled to said source, a gas-hydraulic accumulator connected to said motor-driven pump to be pressurized thereby, and a hydraulic motor connected to said hydraulic pump to drive the same, said hydraulic motor being coupled to said accumulator and to said source for discharge thereto to form a second hydraulic circuit separate from the first, said hydraulic motor being drivingly coupled to said motor-driven pump, at least one of said hydraulic pump and said hydraulic motor having variable displacement volume.

* * * * *